US008824723B2

(12) United States Patent
Lin

(10) Patent No.: US 8,824,723 B2
(45) Date of Patent: Sep. 2, 2014

(54) ELECTRO-ACOUSTIC TRANSDUCER AND METHOD OF MANUFACTURING THE SAME

(71) Applicant: Chung Hua University, Hsinchu (TW)

(72) Inventor: Jium Ming Lin, Hsinchu (TW)

(73) Assignee: Chung Hua University, Hsinchu (TW)

( * ) Notice: Subject to any disclaimer, the term of this patent is extended or adjusted under 35 U.S.C. 154(b) by 0 days.

(21) Appl. No.: 13/726,430

(22) Filed: Dec. 24, 2012

(65) Prior Publication Data

US 2013/0163807 A1 Jun. 27, 2013

(30) Foreign Application Priority Data

Dec. 27, 2011 (TW) ..... 100148803 A

(51) Int. Cl.

| | |
|---|---|
| ***H04R 1/00*** | (2006.01) |
| ***H04R 9/04*** | (2006.01) |
| ***H04R 31/00*** | (2006.01) |
| ***H04R 7/04*** | (2006.01) |
| ***H04R 3/00*** | (2006.01) |
| *H04R 1/24* | (2006.01) |

(52) U.S. Cl.

CPC ..... *H04R 3/00* (2013.01); *H04R 9/047* (2013.01); *H04R 1/24* (2013.01); *H04R 2307/025* (2013.01); *H04R 31/00* (2013.01); *H04R 7/045* (2013.01); *H04R 9/045* (2013.01); *H04R 2440/05* (2013.01)

USPC ..... 381/396; 381/401

(58) Field of Classification Search

CPC ..... H04R 9/00; H04R 9/025; H04R 9/06; H04R 9/08; H04R 9/10; H04R 9/02; H04R 2400/00

USPC ..... 381/396, 408, 409, 423, 431

See application file for complete search history.

(56) References Cited

U.S. PATENT DOCUMENTS

| | | | | |
|---|---|---|---|---|
| 3,674,946 A * | 7/1972 | Winey | ..... | 381/408 |
| 6,137,891 A * | 10/2000 | Porrazzo et al. | ..... | 381/408 |
| 7,251,342 B2 * | 7/2007 | Graebener | ..... | 381/431 |

* cited by examiner

*Primary Examiner* — Curtis Kuntz
*Assistant Examiner* — Sunita Joshi
(74) *Attorney, Agent, or Firm* — WPAT, P.C.; Anthony King; Kay Yang

(57) ABSTRACT

An electro-acoustic transducer includes an insulative flexible substrate, a base, and a magnetic field generator. The base includes a cavity and a magnetic portion disposed below the cavity. The insulative flexible substrate is configured to cover the cavity. The magnetic field generator can be disposed on the insulative flexible substrate and corresponds to the cavity. The magnetic field generator can produce a magnetic field and a reverse magnetic field to cause the magnetic field generator and the magnetic portion of the base to attract and repel each other, thereby vibrating the insulative flexible substrate.

20 Claims, 6 Drawing Sheets

ELECTRO-ACOUSTIC TRANSDUCER AND METHOD OF MANUFACTURING THE SAME

CROSS-REFERENCE TO RELATED APPLICATION

The present application is based on, and claims priority from, Taiwan Patent Application Serial Number 100148803, filed on Dec. 27, 2011, the disclosure of which is hereby incorporated by reference herein in its entirety.

BACKGROUND OF THE INVENTION

1. Field of the Invention

The present invention relates to an electro-acoustic transducer.

2. Description of the Related Art

An ultra-thin, flexible speaker (also called a paper-thin, flexible speaker or an electrostatic speaker) has a first electrode, a second electrode, and a vibratile, thin metal film substrate, which carries positive charges and is disposed between the first electrode and the second electrode. When positive charges are transferred to the first electrode and negative charges are transferred to the second electrode, the metal film substrate moves away from the first electrode but closer to the second electrode; however, when negative charges are transferred to the first electrode and positive charges are transferred to the second electrode, the metal film substrate moves closer to the first electrode but away from the second electrode. When the changes of the electric polarities of the first and second electrodes continue, the metal film substrate will vibrate, compress air, and produce sound waves.

The vibratile, thin metal film substrate can be obtained by vapor-depositing an electrically conductive metal layer on a Mylar substrate. Charges are transferred to the thin metal film in order to carry charges.

It is insufficient to only use small audio electric signals to generate useful forces of electrostatic attraction and repulsion to drive a thin flexible speaker. Normally, a voltage booster is needed to amplify the audio frequency signals, which then increasing their voltage levels. Unfortunately, the danger of electric shock may be caused by such high voltages.

SUMMARY OF THE INVENTION

One embodiment of the present invention provides an electro-acoustic transducer, which comprises an insulative flexible substrate, a base, and a magnetic field generator. The base comprises a cavity and a magnetic portion. The magnetic portion can be below the cavity. The insulative flexible substrate can cover the cavity. The magnetic field generator is disposed on the insulative flexible substrate and corresponds to the cavity. The magnetic field generator is configured to generate a magnetic field and a reverse magnetic field to cause the magnetic field generator and the magnetic portion of the base to attract and repel each other, thereby vibrating the insulative flexible substrate.

In one embodiment, to achieve a desired resonant effect to sounds in a frequency range, a plurality of openings can be formed in the insulative flexible substrate to allow air to flow into or out of the cavity. The size and the depth of the cavity can be changed to generate a desired resonant effect to sounds in a desired frequency range.

Another embodiment of the present invention provides an electro-acoustic transducer, which comprises an insulative flexible substrate, a base, a coil, a signal processor, and an audio signal connector. The insulative flexible substrate can comprise a first surface and a second surface. The base can comprise a cavity and a magnetic portion. The base can be attached to the first surface of the insulative flexible substrate. The insulative flexible substrate can cover the cavity. The magnetic portion and the first surface can be disposed on opposite sides of the cavity. The coil can be disposed on the second surface, corresponding to the cavity. The coil can generate a magnetic field and a reverse magnetic field to cause the coil and the magnetic portion of the base to attract and repel each other, thereby vibrating the insulative flexible substrate. The signal processor is coupled with the coil. The signal processor is configured to filter and amplify an audio signal and to drive the coil to generate the magnetic field and the reverse magnetic field. The audio signal connector is coupled with the signal processor. The audio signal connector is configured to provide the coil with a signal that causes the coil to generate the magnetic field or the reverse magnetic field.

In one embodiment, to achieve a desired resonant effect to make sounds in a frequency range, the size, shape, and thickness of the coil can be changed.

One embodiment of the present invention discloses a method of manufacturing an electro-acoustic transducer. The method comprises forming a coil on an insulative flexible substrate; forming a base with a cavity using a mixture of a polymer and magnetic powder; and attaching the base to the insulative flexible substrate with the coil corresponding in position to the cavity.

To better understand the above-described objectives, characteristics and advantages of the present invention, embodiments, with reference to the drawings, are provided for detailed explanations.

BRIEF DESCRIPTION OF THE DRAWINGS

The invention will be described according to the appended drawings in which.

DETAILED DESCRIPTION OF THE INVENTION

Figure 1:
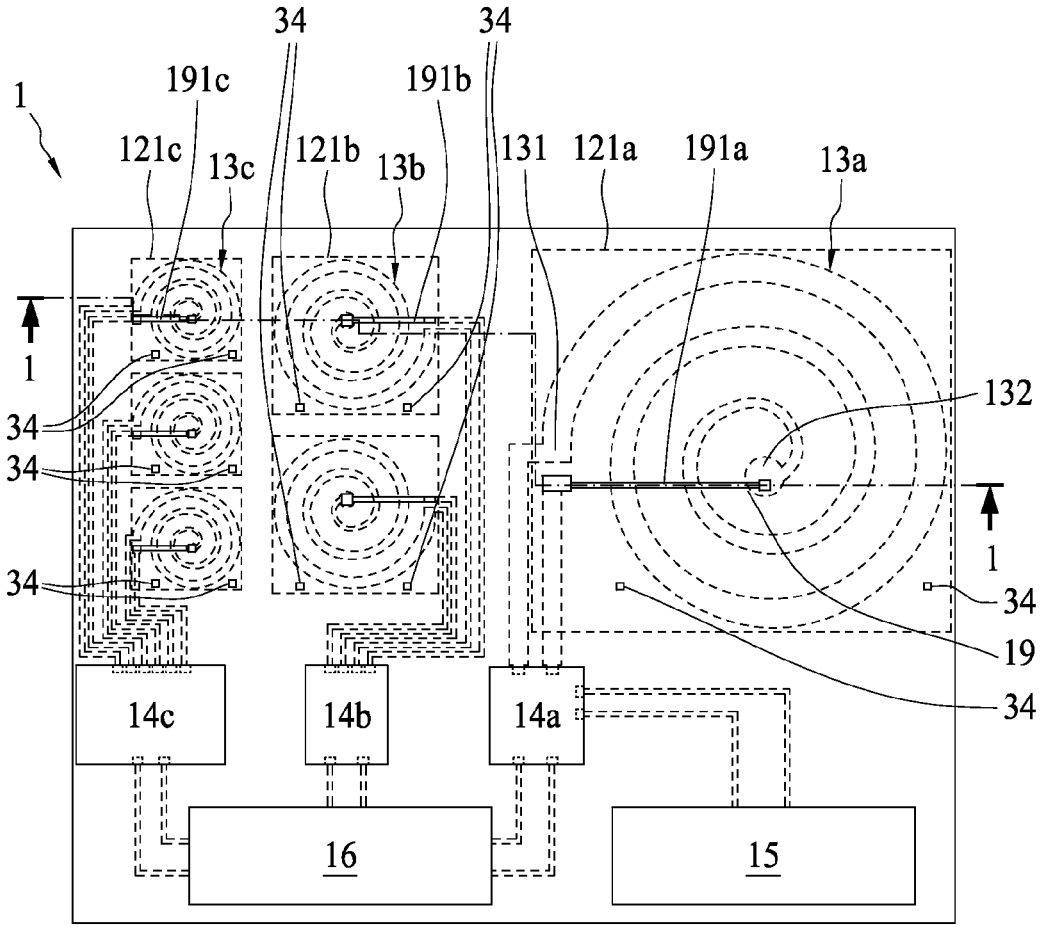
FIG. 1 is a schematic view showing an electro-acoustic transducer according to one embodiment of the present invention.
Figure 2:
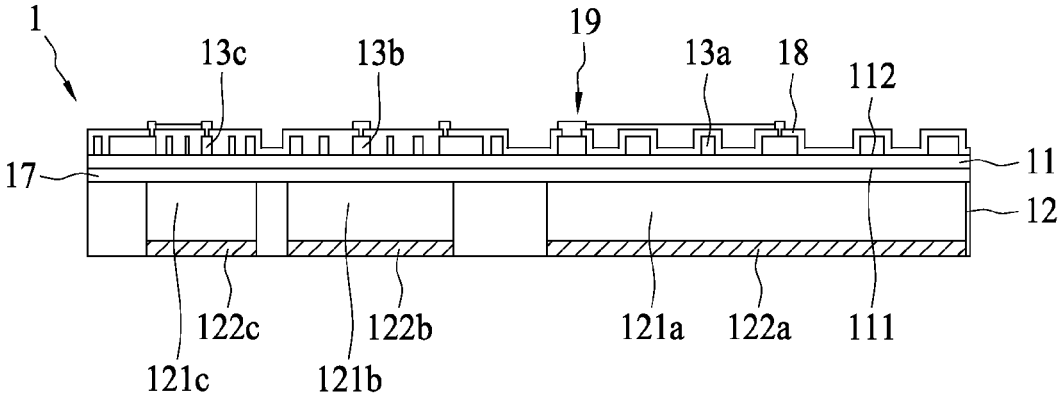
FIG. 2 is a cross-sectional view along line 1-1 of FIG. 1.

FIG. 1 is a schematic view showing an electro-acoustic transducer 1 according to one embodiment of the present invention. FIG. 2 is a cross-sectional view along line 1-1 of FIG. 1. Referring to FIGS. 1 and 2, the electro-acoustic transducer 1 comprises an insulative flexible substrate 11, a base 12, and at least one magnetic field generator (13*a*, 13*b*, or 13*c*). The base 12 can be formed with at least one cavity (121*a*, 121*b* or 121*c*) and at least one magnetic portion (122*a*, 122*b* or 122*c*), each formed below a corresponding cavity (121*a*, 121*b* or 121*c*), as shown in FIG. 1. The insulative flexible substrate 11 is disposed on the base 12, covering the at least one cavity (121*a*, 121*b* or 121*c*). The insulative flexible substrate 11 can be supported by the base 12 and the cavity (121*a*, 121*b* or 121*c*) provides space to allow the insulative flexible substrate 11 to vibrate. The magnetic field generator (13*a*, 13*b*, or 13*c*) corresponds to the at least one cavity (121*a*, 121*b* or 121*c*) and is formed on the insulative flexible substrate 11. The magnetic field generator (13*a*, 13*b*, or 13*c*) is configured to generate a magnetic field and a reverse magnetic field. The magnetic field or reverse magnetic field can interact with the corresponding magnetic portion (122*a*, 122*b* or 122*c*), thereby generating forces of attraction or repulsion on the magnetic field generator (13*a*, 13*b*, or 13*c*) and moving the insulative flexible substrate 11. As the magnetic field generator (13*a*, 13*b*, or 13*c*) continuously and alternatively generates magnetic fields and reverse magnetic fields, the insulative flexible substrate 11 may vibrate, compress air, and generate sound waves.

In one embodiment, as shown in FIG. 2, the insulative flexible substrate 11 may comprise a first surface 111 and a second surface 112. The base 12 can be attached to the first surface 111 of the insulative flexible substrate 11 using an adhesive 17. In one embodiment, the magnetic portion (122*a*, 122*b* or 122*c*) and the first surface 111 can be oppositely disposed relative to the at least one cavity (121*a*, 121*b* or 121*c*). In one embodiment, the magnetic field generator (13*a*, 13*b*, or 13*c*) can be disposed on the second surface 112.

As shown in FIG. 1, in one embodiment, the electro-acoustic transducer 1 may comprise a plurality of magnetic field generators (13*a*, 13*b*, and 13*c*). The plurality of magnetic field generators (13*a*, 13*b*, and 13*c*) are configured to vibrate corresponding portions of the insulative flexible substrate 11, which have different sizes such that the electro-acoustic transducer 1 can produce sounds of different frequencies. In one embodiment, the electro-acoustic transducer 1 may comprise a magnetic field generator 13*a*, which is configured to vibrate a large portion of the insulative flexible substrate 11 to generate sounds in a low frequency range. Correspondingly, the at least one cavity 121*a* under the magnetic field generator 13*a* has a larger area. In one embodiment, the electro-acoustic transducer 1 may comprise a plurality of magnetic field generators 13*b*, each configured to vibrate a smaller portion of the insulative flexible substrate 11 to generate sounds in a mid-frequency range. Correspondingly, cavities 121*b* with smaller areas are disposed under the magnetic field generators 13*b*. In one embodiment, the electro-acoustic transducer 1 may comprise a plurality of magnetic field generators 13*c*, each configured to vibrate a further smaller portion of the insulative flexible substrate 11 to generate sounds in a high frequency range. Correspondingly, cavities 121*c* with the smallest areas are disposed under the magnetic field generators 13*c*.

The magnetic field generator (13*a*, 13*b*, or 13*c*) can be any device that can produce a magnetic field. In one embodiment, the magnetic field generator (13*a*, 13*b*, or 13*c*) may comprise a planar coil. In one embodiment, the planar coil may comprise an electrically conductive adhesive.

In one embodiment, the base 12 may comprise a polymer, such as plastic. In other words, the base 12 can be formed by injection molding. Moreover, the magnetic portion (122*a*, 122*b* or 122*c*) may comprise a polymer and magnetic powder. The magnetic powder may comprise permanent magnetic ferrite powder. In one embodiment, the base 12 may comprise a polymer and magnetic powder, and the base 12 can be molded by a mixture of material of the polymer and the magnetic powder.

As shown in FIG. 1, in one embodiment, the electro-acoustic transducer 1 may further comprise at least one signal processor (14*a*, 14*b*, or 14*c*). The signal processor (14*a*, 14*b*, or 14*c*) is coupled with a corresponding magnetic field generator (13*a*, 13*b*, or 13*c*) to drive the magnetic field generator (13*a*, 13*b*, or 13*c*) to produce a magnetic field or a reverse magnetic field.

Specifically, when the magnetic field generator 13*a* is a coil and the signal processor 14*a* provides a current flowing from an outer end 131 of the magnetic field generator 13*a* to the inner end 132 of the magnetic field generator 13*a*, the magnetic field generator 13*a* produces a magnetic field. Moreover, when the signal processor 14*a* reverses the direction of the current, flowing from the inner end 132 toward the outer end 131, the magnetic field generator 13*a* produces a reverse magnetic field.

In one embodiment, when the electro-acoustic transducer 1 comprises a plurality of magnetic field generators (13*a*, 13*b*, and 13*c*) configured to generate sounds in different frequency ranges, the electro-acoustic transducer 1 may comprise a plurality of signal processors (14*a*, 14*b*, and 14*c*) corresponding to the magnetic field generators (13*a*, 13*b*, and 13*c*) for driving the magnetic field generators (13*a*, 13*b*, and 13*c*).

The electro-acoustic transducer 1 may further comprise a battery socket 15, which can be coupled with the at least one signal processor (14*a*, 14*b*, or 14*c*) and configured to be able to connect with a battery for supplying electrical power to the electro-acoustic transducer 1.

The electro-acoustic transducer 1 may further comprise an audio signal connector 16, which can be coupled with the at least one signal processor (14*a*, 14*b*, or 14*c*) and configured to be able to connect with a plug of an audio source such that the audio source can provide audio signals for the signal processor (14*a*, 14*b*, or 14*c*) through the audio signal connector 16, and the signal processor (14*a*, 14*b*, or 14*c*) can generate signals for driving the magnetic field generator (13*a*, 13*b*, or 13*c*) using the audio signals. In one embodiment, the at least one signal processor (14*a*, 14*b*, or 14*c*) comprises an amplifier, which can amplify audio signals for driving the magnetic field generator (13*a*, 13*b*, or 13*c*).

As shown in FIGS. 1 and 2, the electro-acoustic transducer 1 may further comprise an insulating layer 18 and a circuit layer 19. The insulating layer 18 is configured to cover the at least one magnetic field generator (13*a*, 13*b*, or 13*c*). The circuit layer 19 is formed on the insulating layer 18 and comprises at least one circuit (191*a*, 191*b*, or 191*c*). A plurality of openings can be formed on the insulating layer 18 to expose the inner end 132 of the at least one magnetic field generator (13*a*, 13*b*, or 13*c*) and an end of a conductive line for connecting with the at least one signal processor (14*a*, 14*b*, or 14*c*). The at least one circuit (191*a*, 191*b*, or 191*c*) is configured to connect the inner end 132 and the end of the conductive line.

Figure 3:
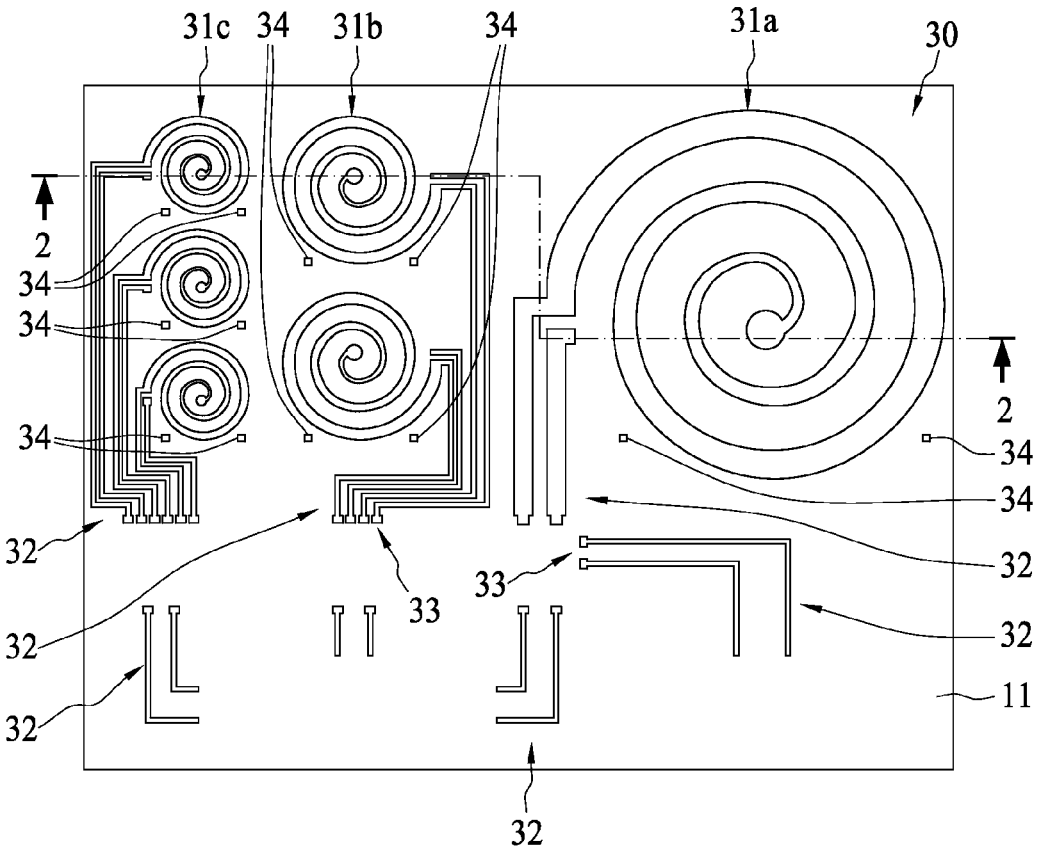
FIG. 3 is a schematic view showing coils of an electro-acoustic transducer according to one embodiment of the present invention.
Figure 4:
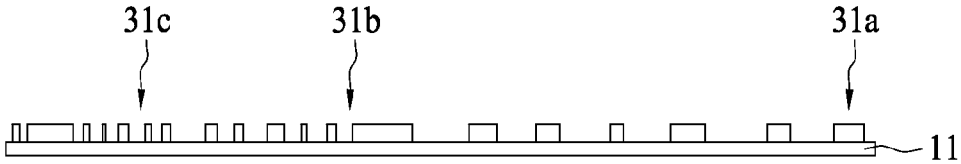
FIG. 4 is a cross sectional view along line 2-2 of FIG. 3.

One embodiment of the present invention discloses a method of manufacturing an electro-acoustic transducer. Referring to FIGS. 3 and 4 (showing cross sections along line 2-2 of FIG. 3), the method initially forms a circuit layer 30 on an insulative flexible substrate 11, wherein the circuit layer 30 comprises at least one coil (31*a*, 31*b*, or 31*c*), and a plurality of conductive lines 32 and conductive pads 33. A portion of conductive lines 32 are connected with the outer end of the at least one coil (31*a*, 31*b*, or 31*c*) and corresponding conductive pads 33. One group of ends of a portion of conductive lines 32 are connected with the corresponding conductive pads 33, while another group of ends of the portion of the conductive lines 32 extend adjacent to the at least one coil (31*a*, 31*b*, or 31*c*). The insulative flexible substrate 11 may comprise a polymer, such as plastic. The circuit layer 30 can be formed on the insulative flexible substrate 11 using a screen-printing technology. The circuit layer 30 can be a conductive adhesive pattern with a thickness range of 20 to 100 micrometers and made by silver paste.

Figure 5:
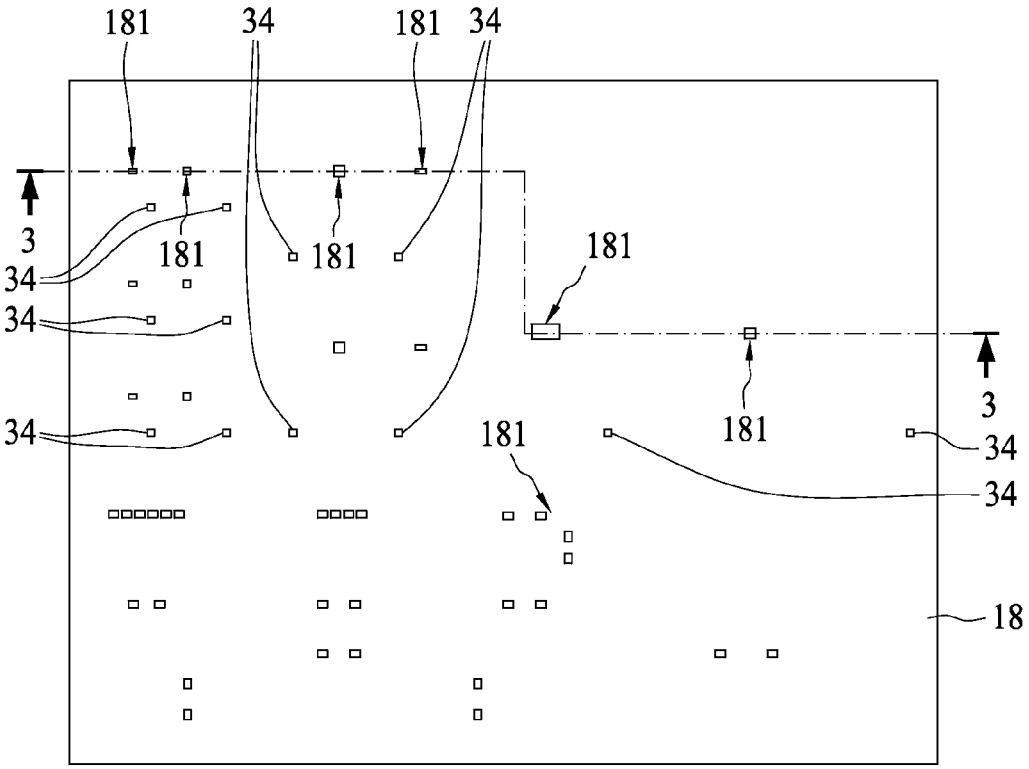
FIG. 5 is a schematic view showing an insulating layer covering coils according to one embodiment of the present invention.
Figure 6:
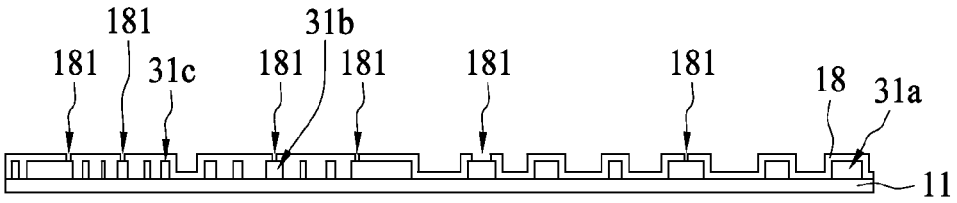
FIG. 6 is a cross-sectional view along line 3-3 of FIG. 5.

Referring to FIGS. 5 and 6 (showing cross sections along line 3-3 of FIG. 5), an insulating layer 18 is formed to cover the circuit layer 30. In one embodiment, the insulating layer 18 may comprise a photoresist. In one embodiment, the insulating layer 18 may comprise polyvinylamine. In one embodiment, the insulating layer 18 can have a thickness range of 1 to 10 micrometers. A plurality of openings 181 are formed on the insulating layer 18. The openings 181 can expose a portion of the inner end of the at least one coil (31*a*, 31*b*, or 31*c*) and the ends of the conductive lines 32 adjacent to the at least one coil (31*a*, 31*b*, or 31*c*).

Figure 7:
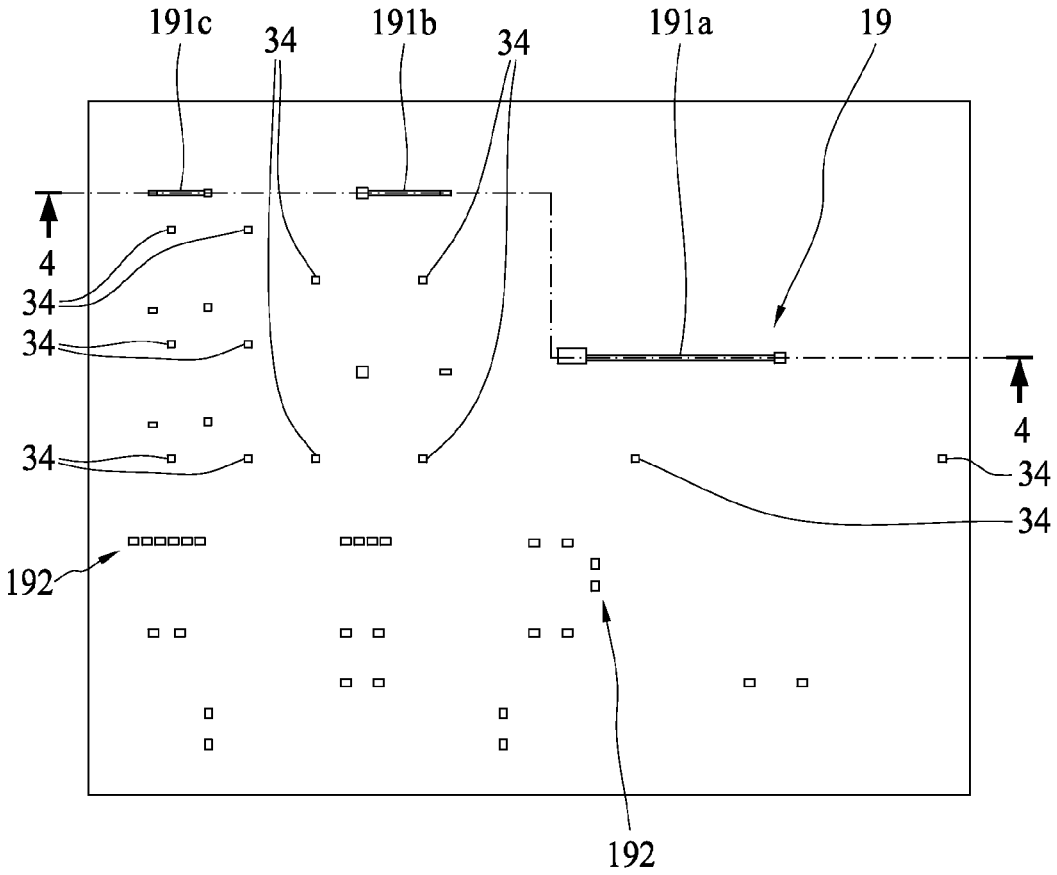
FIG. 7 is a schematic view showing a circuit layer formed on an insulating layer according to one embodiment of the present invention.
Figure 8:
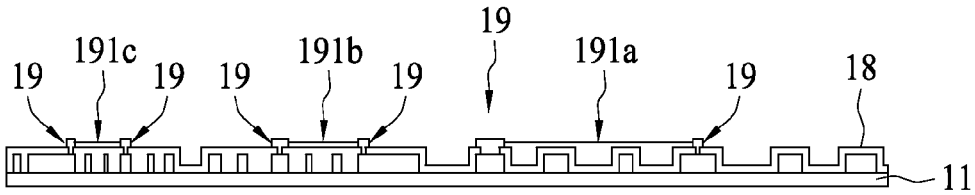
FIG. 8 is a cross-sectional view along line 4-4 of FIG. 7.

Referring to FIGS. 7 and 8 (showing cross sections along line 4-4 of FIG. 7), a circuit layer 19 is formed on the insulating layer 18. The circuit layer 19 may comprise at least one conductive line (191*a*, 191*b*, or 191*c*). The at least one conductive line (191*a*, 191*b*, or 191*c*) connects the inner end of the at least one coil (31*a*, 31*b*, or 31*c*) and an end of the conductive line 32 adjacent to the at least one coil (31*a*, 31*b*, or 31*c*). The circuit layer 19 can have a thickness range of 20 to 100 micrometers. The circuit layer 19 can further comprise a plurality of conductive pads 192, which are electrically connected with the corresponding conductive pads 33 of the circuit layer 30.

Figure 9:
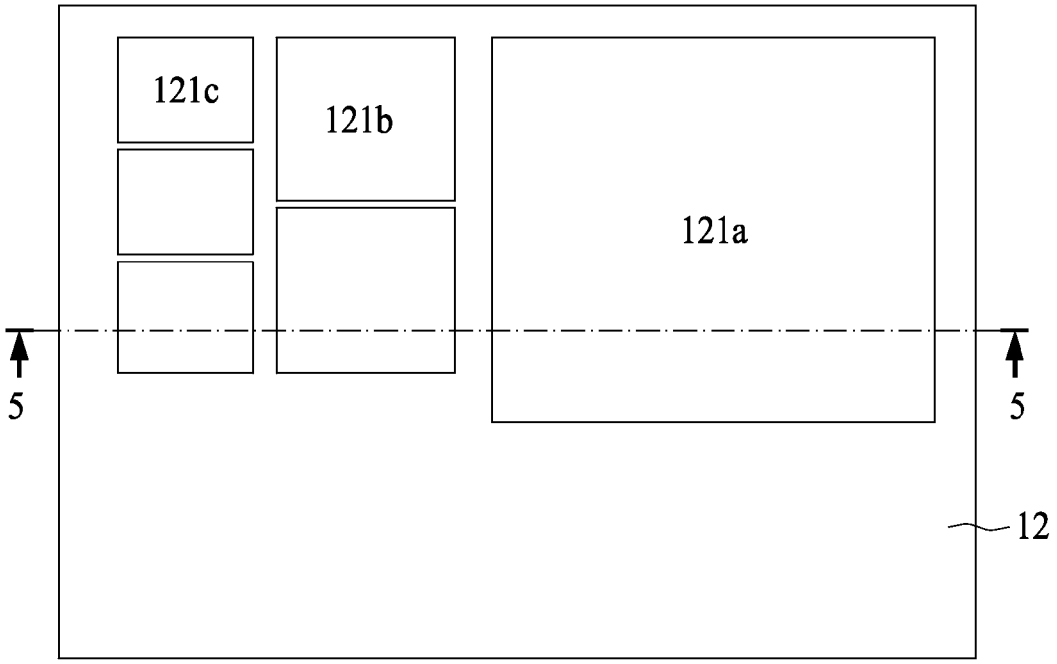
FIG. 9 is a schematic view showing a base according to one embodiment of the present invention.
Figure 10:
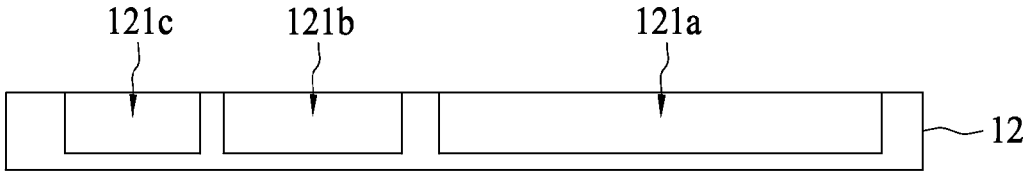
FIG. 10 is a cross-sectional view along line 5-5 of FIG. 9.

Referring to FIGS. 9 and 10 (showing cross sections along line 5-5 of FIG. 9), a mixture is obtained by mixing a polymer and magnetic powder. The mixture is used to form a base 12, which comprises at least one cavity (121*a*, 121*b* or 121*c*). Next, the base 12 is attached to the insulative flexible substrate 11, which covers the at least one cavity (121*a*, 121*b* or 121*c*). The at least one coil (31*a*, 31*b*, or 31*c*) corresponds in position to the at least one cavity (121*a*, 121*b* or 121*c*).

Figure 11:
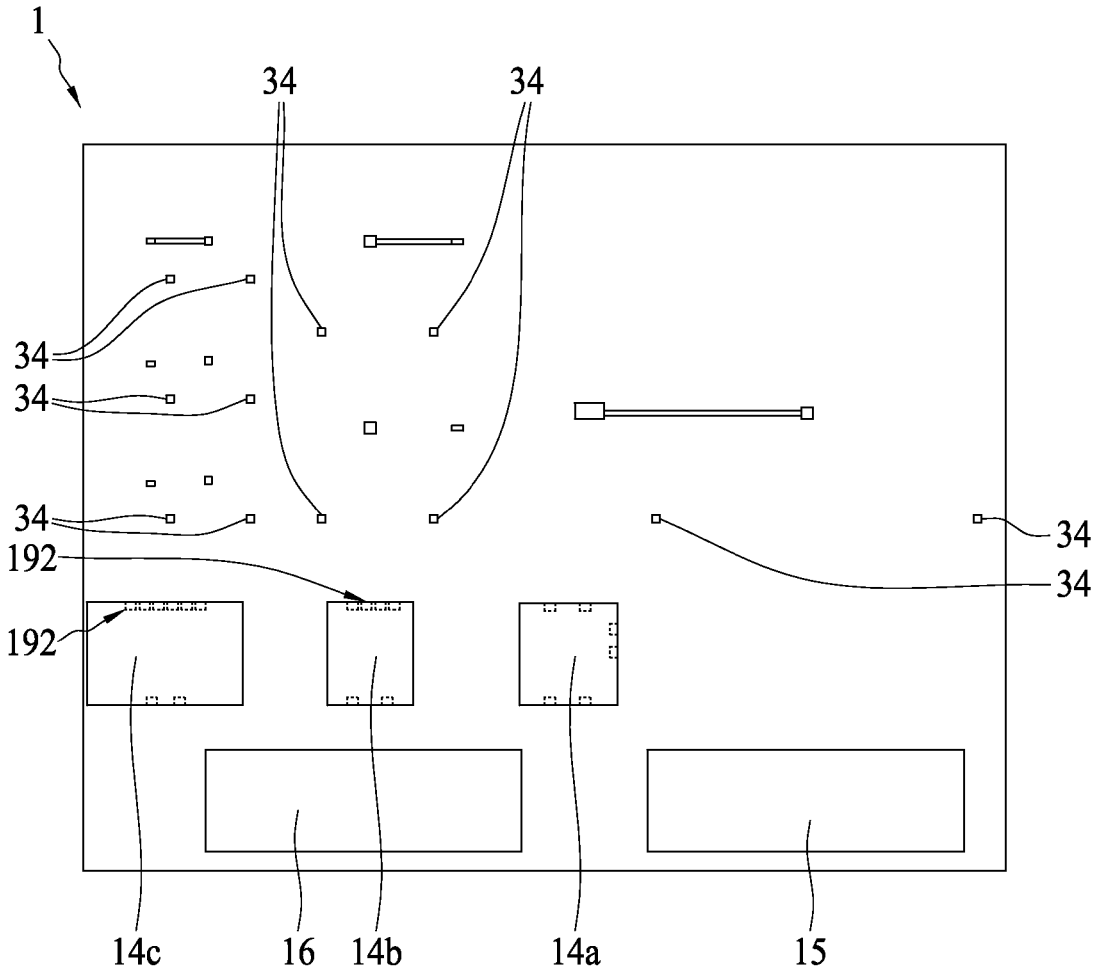
FIG. 11 is a schematic view showing an electro-acoustic transducer according to one embodiment of the present invention.

Referring to FIG. 11, at least one signal processor (14*a*, 14*b*, or 14*c*) is disposed and electrically connected with the plurality of corresponding pads 192. An audio signal connector 16 is disposed on the insulative flexible substrate 11. The audio signal connector 16 is electrically connected with the corresponding pads 192 and the conductive lines 32 extending to connect with the at least one signal processor (14*a*, 14*b*, or 14*c*), as shown in FIG. 3. A battery socket 15 is disposed on the insulative flexible substrate 11. The battery socket 15 is electrically connected with the corresponding pads 192 and another set of conductive lines 32 extending to connect with the at least one signal processor (14*a*, 14*b*, or 14*c*).

In one embodiment, a plurality of openings 34 can be formed on the insulative flexible substrate 11 in advance. The plurality of openings 34 allow air to flow into or out of the cavity (121*a*, 121*b* or 121*c*) when the insulative flexible substrate 11 is vibrating. The size and depth of the cavity (121*a*, 121*b* or 121*c*) can be changed to generate a desired resonant effect to make sounds in a frequency range produced by the integration of the cavity (121*a*, 121*b* or 121*c*) and the insulative flexible substrate 11.

In one embodiment, the size, shape, and thickness of the coil and the thickness and material of the insulative flexible substrate 11 can be changed to generate a desired resonant effect to sounds in a frequency range produced by the integration of the cavity (121*a*, 121*b* or 121*c*) and the insulative flexible substrate 11.

The above-described embodiments of the present invention are intended to be illustrative only. Numerous alternative embodiments may be devised by persons skilled in the art without departing from the scope of the following claims.

What is claimed is:

1. An electro-acoustic transducer comprising:

an insulative flexible substrate;

a base comprising a plurality of cavities covered by the insulative flexible substrate, the plurality of cavities being different in size;

a magnetic portion disposed below the plurality of cavities; and a plurality of magnetic field generators disposed on the insulative flexible substrate and corresponding to the plurality of cavities, the plurality of magnetic field generators being of different sizes corresponding to those of the plurality of cavities;

wherein the plurality of magnetic field generators are configured to produce magnetic fields and reverse magnetic fields to cause the plurality of magnetic field generators and the magnetic portion of the base to attract and repel each other, thereby vibrating different portions of the insulative flexible substrate so as to generate sounds in different frequency ranges.

2. The electro-acoustic transducer of claim 1, wherein each of the plurality of magnetic field generators comprises a planar coil.

3. The electro-acoustic transducer of claim 2, wherein each of the plurality of magnetic field generators comprises a conductive adhesive.

4. The electro-acoustic transducer of claim 1, wherein the magnetic portion is molded by a mixture of the materials of polymer and magnetic powder.

5. The electro-acoustic transducer of claim 1, wherein the base is molded by a mixture of the materials of polymer and magnetic powder.

6. The electro-acoustic transducer of claim 1, further comprising a signal processor coupled with the plurality of magnetic field generators, wherein the signal processor is configured to drive the plurality of magnetic field generators to produce the magnetic fields and the reverse magnetic fields.

7. The electro-acoustic transducer of claim 6, further comprising a battery socket coupled with the signal processor.

8. The electro-acoustic transducer of claim 6, further comprising an audio signal connector coupled with the signal processor.

9. An electro-acoustic transducer comprising:

an insulative flexible substrate comprising a first surface and a second surface;

a base comprising a plurality of cavities and a magnetic portion, wherein the base is attached to the first surface, the insulative flexible substrate covers the plurality of cavities, and the magnetic portion and the first surface are oppositely disposed relative to the plurality of cavities, the plurality of cavities being different in size;

a plurality of coils disposed on the second surface and corresponding to the plurality of cavities, the plurality of coils being of different sizes corresponding to those of the plurality of cavities, wherein the plurality of coils are configured to generate magnetic fields and reverse magnetic fields to cause the plurality of coils and the magnetic portion of the base to attract and repel each other, thereby vibrating different portions of the insulative flexible substrate so as to generate sounds in different frequency ranges;

a signal processor coupled with the plurality of coils, the signal processor configured to filter and amplify an audio signal and to drive the plurality of coils to generate the magnetic field and the reverse magnetic field; and an audio signal connector coupled with the signal processor, configured to provide the plurality of coils with a signal that causes the plurality of coils to generate the magnetic field or the reverse magnetic field.

10. The electro-acoustic transducer of claim 9, wherein the plurality of coils comprise a conductive adhesive.

11. The electro-acoustic transducer of claim 9, wherein the magnetic portion is molded by a mixture of the materials of polymer and magnetic powder.

12. The electro-acoustic transducer of claim 9, wherein the base is molded by a mixture of the materials of polymer and magnetic powder.

13. The electro-acoustic transducer of claim 9, further comprising a battery socket coupled with the signal processor.

14. The electro-acoustic transducer of claim 9, further comprising an insulting layer covering the plurality of coils and a circuit formed on the insulating layer, wherein the circuit is coupled with the audio signal connector and an inner end of the plurality of coils.

15. A method of manufacturing an electro-acoustic transducer, comprising the steps of:

forming a plurality of coils on an insulative flexible substrate, the plurality of coils comprising different sizes;

forming a base with a plurality of cavities using a mixing materials of polymer and magnetic powder, the plurality of cavities being of different sizes corresponding to those of the plurality of coils; and attaching the base to the insulative flexible substrate with the plurality of coils corresponding in position to the plurality of cavities.

16. The method of claim 15, further comprising the steps of:

covering the plurality of coils with an insulating layer; and forming a circuit coupled with an inner end of the plurality of coils on the insulating layer.

17. The method of claim 15, further comprising a step of disposing a signal processor coupled with the plurality of coils on the insulative flexible substrate.

18. The method of claim 17, further comprising a step of disposing a battery socket coupled with the signal processor on the insulative flexible substrate.

19. The method of claim 17, further comprising a step of disposing an audio signal connector coupled with the signal processor on the insulative flexible substrate.

20. The method of claim 15, further comprising a step of forming a plurality of openings on the insulative flexible substrate.

* * * * *